US005806133A

United States Patent [19]

Iida

[11] Patent Number: 5,806,133

[45] Date of Patent: Sep. 15, 1998

[54] PORTABLE WORK MACHINE

[75] Inventor: Giichi Iida, Tokyo, Japan

[73] Assignee: Kioritz Corporation, Tokyo, Japan

[21] Appl. No.: 645,421

[22] Filed: May 13, 1996

[30] Foreign Application Priority Data

May 16, 1995 [JP] Japan ..... 7-117023

[51] Int. Cl.[6] ..... A47L 5/24

[52] U.S. Cl. ..... 15/412; 15/405

[58] Field of Search ..... 15/328, 330, 344, 15/405, 412; 123/198 E; 248/638

[56] References Cited

U.S. PATENT DOCUMENTS

| | | | |
|---|---|---|---|
| 2,227,302 | 12/1940 | Edstrom | 15/330 |
| 2,905,267 | 9/1959 | Thompson | 15/330 |
| 4,223,419 | 9/1980 | Sato et al. . | |
| 4,269,571 | 5/1981 | Shikutani et al. . | |
| 4,318,203 | 3/1982 | Satoh et al. . | |
| 4,517,939 | 5/1985 | Kiyooka | 123/198 E |
| 4,644,606 | 2/1987 | Luerken et al. . | |
| 4,657,477 | 4/1987 | Shinoda . | |
| 4,674,146 | 6/1987 | Tuggle et al. | 15/330 |
| 4,913,112 | 4/1990 | Iida . | |
| 5,349,721 | 9/1994 | Iida . | |
| 5,457,846 | 10/1995 | Kuwano | 15/405 |
| 5,586,359 | 12/1996 | Iida | 15/330 |

*Primary Examiner*—Terrence Till
*Attorney, Agent, or Firm*—Armstrong, Westerman, Hattori, McLeland & Naughton

[57] ABSTRACT

In a portable work machine having a prime mover, a driven unit such as a fan to be driven by the prime mover, a machine case made of synthetic resin and including an inlet port case, a central case and an engine case, a bottom portion of the central case is integrally formed with stands each having a hollow which opens at one side end of the bottom portion. A cutting is formed in the bottom portion to provide the hollow with an upper wall which opens partly. The bottom of the stand is formed with a raised edge.

9 Claims, 3 Drawing Sheets

PORTABLE WORK MACHINE

BACKGROUND OF THE INVENTION

1. Field of the Invention

The present invention relates to a portable work machine of hand-held type, shoulder type or back type such as, for example, a hand-held power blower which is used for cleaning work carried out to collect fallen leaves and dust or the like by using blast and which has a prime mover such as an air-cooled two-cycle gasoline engine or an electric motor and a driven unit such as a fan driven by the prime mover.

2. Description of the Prior Art

In this type of portable work machine, weight reduction has been desired strongly from the viewpoint of easy-to-handle requirement and recently, a synthetic resin material has been used frequently for constituent parts. Typically, a machine case made of synthetic resin and housing the prime mover and the driven unit is formed integrally with a bottom portion also made of synthetic resin, as disclosed in, for example, JU-A-1-105791 and JP-A-61-283795.

Also, in this type of portable work machine, the prime mover such as an air-cooled two-cycle gasoline engine or an electric motor and the driven unit such as a fan driven by the prime mover are generally juxtaposed or placed side by side. Since the prime mover is heavier than the driven unit and so the position of center of gravity of the work machine as a whole is often offset toward right or left.

In the conventional portable work machine in which the case of synthetic resin is formed to include the bottom portion as described above, the bottom portion takes the form of a continuous, relatively wide flat surface to promote, for example, its stability. However, when the portable work machine having the bottom portion removed of projection and flattened and especially having the position of the center of gravity being offset to right or left of the machine is placed on the ground, especially, on a hard road surface made of, for example, concrete, the bottom portion is often damaged because of shock caused upon placement and vibration due to operation of the prime mover.

To avoid the disadvantages as above, it is conceivable to mount legs for support to the bottom portion but with the legs merely mounted, the shock and vibration cannot be absorbed effectively, so that not only damage of the bottom portion cannot be prevented but also labor and time of assembling, weight and cost of production are disadvantageously increased.

SUMMARY OF THE INVENTION

The present invention contemplates elimination of the above problems and it is an object of the present invention to provide a portable work machine which can effectively absorb shock and vibration caused upon placement of the machine on the ground to make the bottom portion hardly suffer damage even when the bottom portion is also made of a synthetic resin material with a view of reducing weight and which can suppress the increase of labor and time of assembling, weight and product cost as far as possible.

To accomplish the above object, according to the present invention, in a portable work machine comprising a prime mover and a driven unit such as a fan driven by the prime motor, at least a bottom portion of a machine case is made of synthetic resin, and the bottom portion is integrally formed with stands each having a hollow which opens at one end.

The shape of the stand provided to the bottom portion of the work machine is not particularly limitative but preferably, the stand extends from one side end of the bottom portion to cross the bottom portion and a cutting is formed in the bottom portion to extend from the one side end of the bottom portion in a direction of extension of the stand in order to provide the hollow with an upper wall which opens partly; and in addition, the stand has a cross section defined by a bowl-like external contour, the bottom of the stand is provided with a raised edge, the stands are disposed on both sides of the centrally arranged prime mover when seen in the side view, a plurality of stands are provided, and the stand takes the form of an elongated trough which extends to cross the bottom portion and opens partly at the upper wall.

Preferably, when the stand takes the form of an elongated trough which opens partly at the upper wall, a plurality of stands are provided in parallel with the output shaft of the prime mover, each stand opens at one end and each stand has its bottom provided with a raised edge.

In the portable work machine according to the present invention constructed as above, by virtue of the provision of the stands to the bottom portion, stability can be promoted and upon placement of the machine on the ground, the stands first come in contact with the ground. At that time, thanks to the structure of the stand having the hollow which opens at one end, the stand can be elastically deformed with ease especially at the opened one end to exhibit a cushion characteristic (buffer action). Accordingly, even when the machine is placed on, for example, the hard ground, the stand plays the role of a shock absorber and as a result, shock caused upon placement and vibration due to operation of the prime mover can be absorbed effectively to make the bottom portion made of synthetic resin hardly suffer damage. In particular, this advantage can be enhanced by causing the opened one end of the stand to first come in contact with the ground in the case of a machine in which the position of the center of gravity is offset toward a right or left half of the machine.

By forming the stand integrally with the bottom portion, the stand can also serve as reinforcement (rib) and labor and time of assembling, cost of parts and weight can be reduced; and besides, the bottom portion need not be flattened, thus promoting the degree of freedom of design and esthetics.

By extending the stand from one side end of the bottom portion to cross the bottom portion and forming, in the bottom portion, the cutting which extends from the one side end of the bottom portion in the direction of extension of the stand in order to provide the hollow with an upper wall which opens partly, the stand can be deformed elastically more easily and shock due to placement of the machine on the ground and vibration due to operation of the prime mover can be absorbed more effectively.

By making the stand have a cross section defined by a bowl-like external contour, the cushion characteristic can be further improved and weight reduction can be expected, and by providing the bottom of the stand with the raised edge, surface contact pressure exerting the ground or the like on which the machine is placed can be increased to further promote stability and besides, the raised edge can also serve as reinforcement (rib).

By providing a plurality of stands which take the form of an elongated trough opening at the upper wall and at one end and which extend from one side end of the bottom portion in parallel with, for example, the output shaft of the prime mover, each stand can deform elastically very easily at the opened one end so as to drastically improve the cushion characteristic, with the result that not only shock due to placement of the machine on the ground or the like can be absorbed effectively but also relatively large vibration caused in the case of the prime mover being an air-cooled two-cycle gasoline engine can be absorbed effectively.

In this case, the stand also plays the role of a reinforcement rib for the bottom portion of the machine case and with the raised edge provided to the bottom of the stand, stability of the machine can be promoted and the raised edge plays the role of an reinforcement rib for the stand.

With the cutting formed, a coupling rib for coupling a projecting pillar of a metal mold for formation of the hollow of the stand to a main body of the metal mold can be formed necessarily and durable life of the metal mold can be extended.

DESCRIPTION OF THE PREFERRED EMBODIMENTS

The present invention will now be described with reference to the accompanying drawings.

Figure 1:
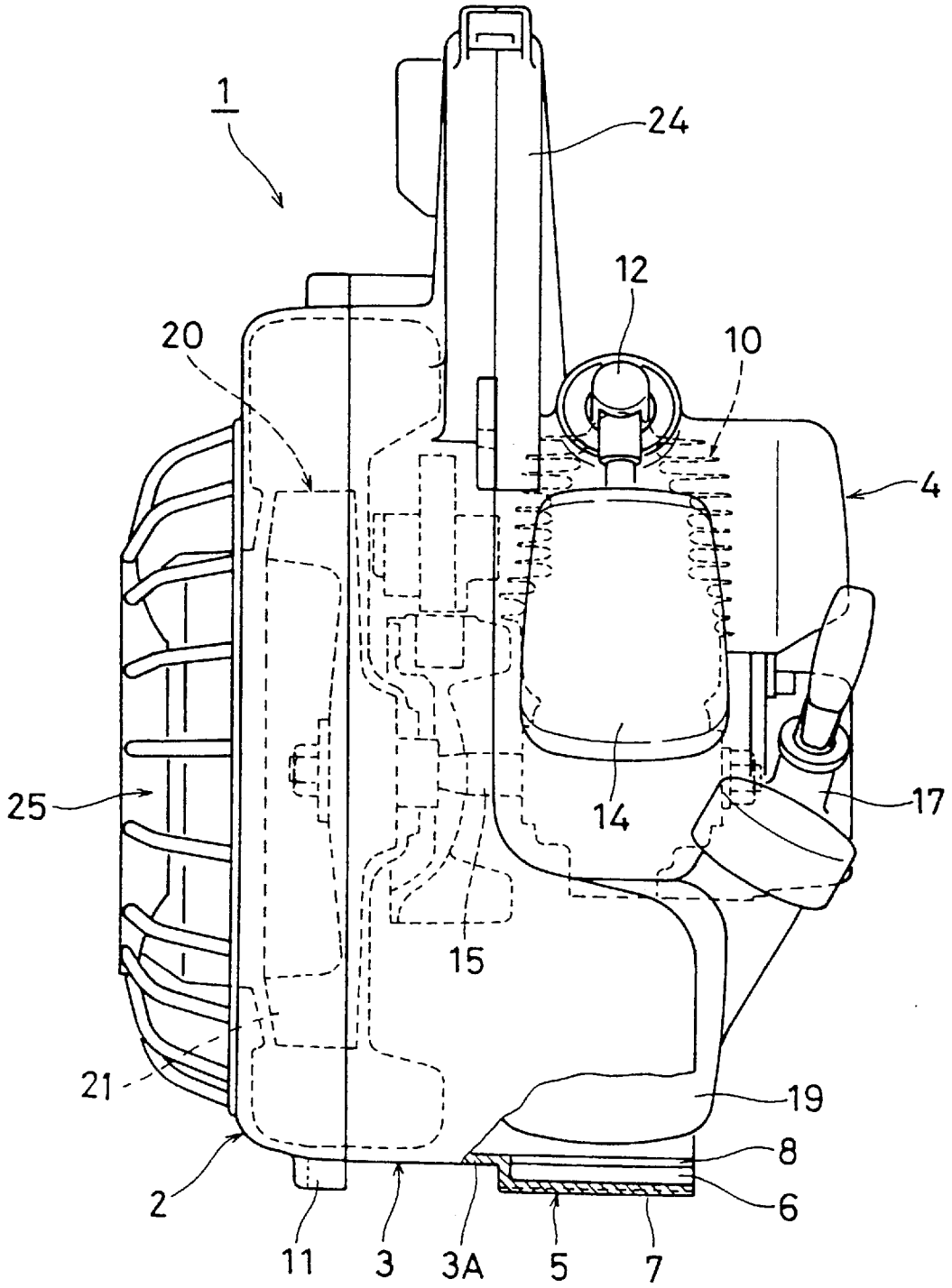
FIG. 1 is a rear view, partly exploded, showing an embodiment of a portable work machine according to the present invention.
Figure 2:
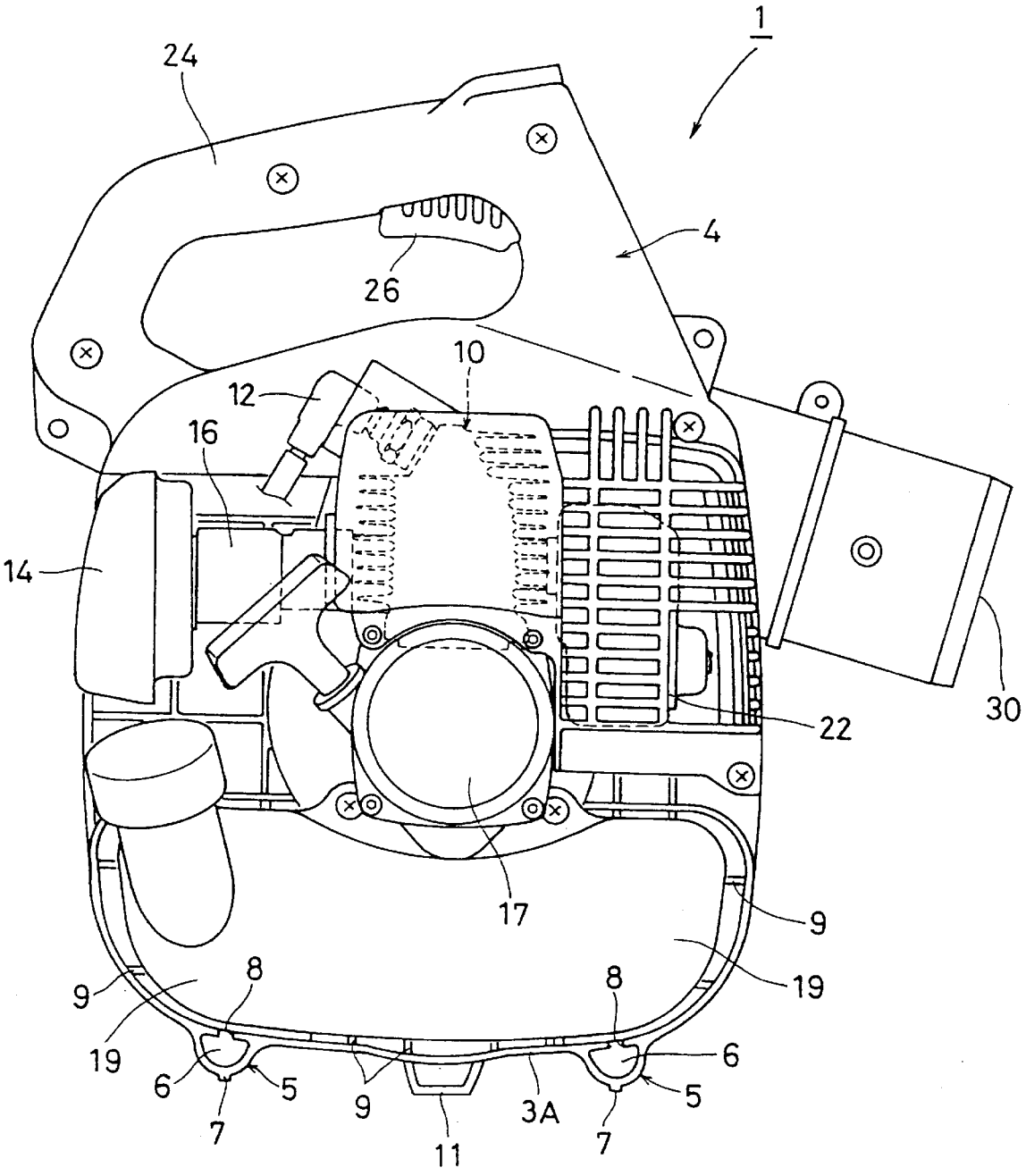
FIG. 2 is a side view of the portable work machine shown in FIG. 1.
Figure 3:
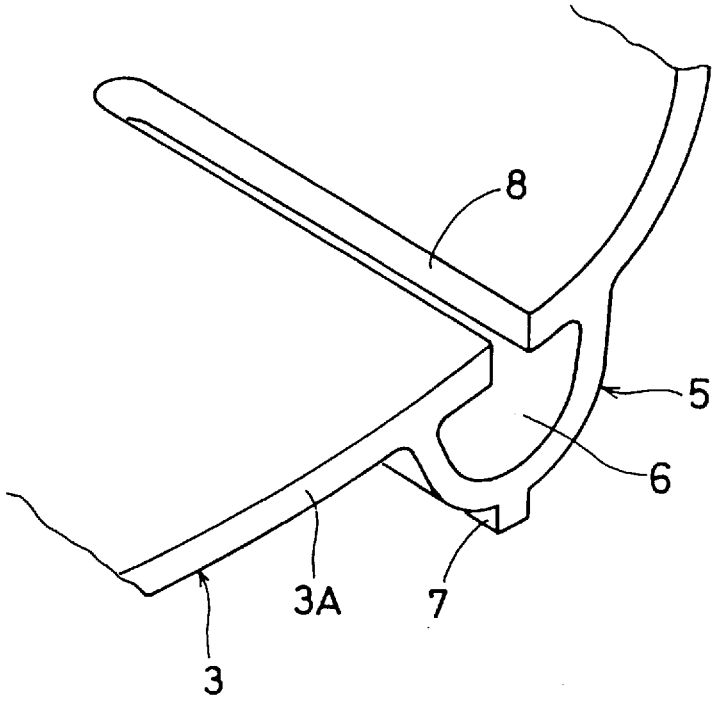
FIG. 3 is an enlarged fragmentary perspective view showing details of a stand of the FIG. 1 embodiment.

Referring to FIGS. 1 and 2, there is illustrated an embodiment of a power blower of hand-held type for cleaning work which is an example of a portable work machine according to the present invention.

The power blower of the present embodiment, generally designated by reference numeral 1, has a machine case constructed of an inlet port case 2, a central case 3 and an engine case 4, the machine case having its outer surface made of synthetic resin and its interior provided with many reinforcement ribs 9, 9, . . . (see FIG. 2). Disposed in the machine case are an air-cooled two-cycle gasoline engine 10 serving as a prime mover and a centrifugal blower unit 20 having a fan 21 fixed to an output shaft 15 of the engine 10. A handle 24 is connected to the tops of the central case 3 and engine case 4 and a throttle trigger 26 to be operated by fingers to adjust the output of the engine 10 is mounted to an upper inner portion of the handle 24.

The engine 10 is attached, in the predetermined fashion, with an ignition plug 12, an air cleaner 14, a carburetor 16, a recoil starter 17 and a muffler 22. The engine 10 standing with its cylinder atop is arranged substantially in the middle of the machine 1 in the front/back direction thereof as viewed from side (FIG. 2) while being offset toward a right half of the machine 1 as viewed from back (FIG. 1) and besides a weighty fuel tank 19 is disposed underneath the engine 10, so that in the power blower 1 of the present embodiment, the center of gravity of the machine 1 as a whole is offset from center to the right so as to lie near the center line of the engine 10 as viewed from rear (FIG. 1).

When the engine 10 is operated, external air is sucked into the blower unit 20 through an inlet port 25 provided on the left side in FIG. 1, then compressed and thereafter exhausted to the outside through an outlet port 30 (FIG. 2) and a not-shown discharge pipe connected thereto, thus ensuring that cleaning work for blowing and collecting fallen leaves and dust can be carried out.

Advantageously, according to the present embodiment, in addition to a usual, suitable stand 11 provided to the bottom of the inlet port case 2, two stands 5 each having a hollow 6 which opens at one end (right end as viewed in FIG. 1) are formed integrally with a bottom portion 3A of the central case 3.

Each of the stands 5, 5 extends from one side end of the bottom portion 3A to cross the bottom portion 3A (to left from the right end in the rear view of FIG. 1) and the bottom portion 3A is formed with a cutting 8 in the form of a slit which extends from the one side end of the bottom portion 3A in the direction of extension of the stand 5 in order to provide the hollow 6 with an upper wall which opens partly.

When seen in the side view (FIG. 2), the stands 5, 5 are disposed frontally and backwardly of the centrally arranged engine 10 in parallel with the output shaft 15 of the engine 10 and when seen in the rear view (FIG. 1), they are formed directly under the engine 10, having substantially the same length as the width of a main body of the engine 10.

The two stands 5, 5 are identical in size and shape, taking the form of an elongated trough (horizontal trough) having a cross section defined by a bowl-like external contour. The elongated trough opens at one end (right side end in FIG. 1), extends from the one side end of the bottom portion 3A of the central case 3 to reach almost the middle of the central case and has its bottom provided with a raised edge 7 of narrow width over the entire length.

The cutting 8 is formed in a part of the bottom portion 3A overlying the stand 5 so as to provide the hollow 6 with an upper wall which opens partly, having substantially the same length as the hollow 6. The cutting 8 has one end (right end in FIG. 1) which opens and the other end which is shaped into a semicircular form.

In the power blower 10 of the present embodiment constructed as above, thanks to the provision of the two trough-like stands 5, 5 to the bottom portion 3A of the central case 3, these stands 5, 5 first come into contact with the ground or the like when the machine 1 is placed on the ground or the like.

At that time, in the power blower 10 of the present embodiment in which the center of gravity of the machine 1 is offset toward right when seen in the rear view (FIG. 1) and the stands 5, 5 are disposed frontally and backwardly of the centrally arranged engine 10 when seen in the side view (FIG. 2) while being disposed directly under the engine 10 when seen in the rear view, these stands cooperate with the usual stand 11 provided to the bottom of the inlet port case 2 to establish a three-point support which makes the power blower 1 stable without causing displacement to increase the stability and makes the power blower 1 hardly fall down.

Further, since the stand 5 has the hollow 6 which opens at one end and the upper wall of the hollow 6 is formed with the cutting 8 which opens at one end, the stand 5 can deform elastically with ease, starting from its opened end (right end in FIG. 1 which, because of the position of the center of gravity, first collides with the ground or the like when the machine 1 is normally placed on the ground or the like) which serves as a base point, and an excellent cushion characteristic (buffer action) can be obtained. Consequently, the stand 5 plays the role of a shock absorber which can effectively absorb shock due to placement of the machine 1 and vibration due to operation of the engine 10, thereby making the bottom portion 3A of the case 3 made of synthetic resin hardly suffer damage.

Further, by virtue of the integral formation of the stand 5 with the central case 3, the stand 5 also serves as reinforcement (rib), time and labor of assembling and cost of parts can be reduced, reduction in weight can be expected and besides the bottom portion 3A need not be flattened, thus improving the degree of freedom of design and esthetics.

Further, since each stand 5, 5 also plays the role of a reinforcement rib for the bottom portion 3A and has its bottom provided with the raised edge 7, stability of the machine 1 can be increased and the raised edge 7 can play the role of a reinforcement rib for the stand 5, 5, thus promoting the strength of not only the stand 5, 5 but also the bottom portion 3A per se.

One embodiment of the present invention has been set forth so far in detail but the present invention is in no way limited to the foregoing embodiment and can be changed in design in various ways without departing from the spirit of the present invention as recited in the appended claim. For example, the shape of the stand is not limited to the trough-like form but may be of a pillar and an electric motor may be used as a prime mover in place of the engine 10.

As will be seen from the foregoing description, in the portable work machine according to the present invention, stability can be improved by providing the stands to the bottom portion of the machine case forming the machine outer surface and the stand can be deformed elastically with ease to exhibit an excellent cushioning characteristic by forming the stand with the hollow which opens at the upper wall thereof and at one end, with the result that shock due to placement of the machine on the ground or the like and vibrations due to operation of the prime mover can be absorbed effectively, making the bottom portion of the case, even made of synthetic resin, hardly suffer damage.

By forming the stand integrally with the case, time and labor of assembling and cost of parts can be reduced and weight can also be reduced.

Further, since the bottom portion need not be flattened, the degree of freedom of design and esthetics can be improved and by forming the stand into a trough-like shape which opens at the upper wall and at one end, the cushioning characteristic can be further improved and weight reduction can be expected.

In addition, by providing the bottom of the stand with the raised edge, stability can be further promoted and the raised edge can serve as reinforcement (rib), thereby attaining an excellent effect that the bottom portion can steadily be prevented from damage.

What is claimed is:

1. A portable work machine comprising:

a prime mover;

a driven unit to be driven by said prime mover;

a plurality of machine cases for enclosing said prime mover and said driven unit, at least a bottom portion of one of said machine cases being made of synthetic resin and having one side end: and opposedly spaced stands formed integrally with said bottom portion of said one machine case and each of said stands having a hollow which opens at only one end thereof.

2. A portable work machine according to claim 1, wherein each one of said stands extends from said one side end of said bottom portion to cross said bottom portion, and said bottom portion has a cutting which extends from the one side end of said bottom portion in a direction of extension of said stand in order to provide said hollow with an upper wall which opens partly.

3. A portable work machine according to claim 1 or 2, wherein each one of said stands (5) has its bottom provided with a raised edge (7).

4. A portable work machine according to claim 3, wherein each one of said stands (5) takes an elongated trough-like form.

5. A portable work machine according to claim 3, wherein said portable work machine is a power blower (1).

6. A portable work machine according to any one of claim 1 or 2, wherein each one of said stands takes an elongated through-like form.

7. A portable work machine according to claim 6, wherein said portable work machine is a power blower (1).

8. A portable work machine according to any one of claim 1 or 2, wherein said portable work machine is a power blower.

9. A portable work machine according to claim 8, wherein said driven unit is a fan (21).

* * * * *